US005237727A

United States Patent [19]

Faas et al.

[11] Patent Number: 5,237,727

[45] Date of Patent: Aug. 24, 1993

[54] ADJUSTABLE CLEANING OF FIBERS IN A SPIRALLED AIR PATH AND APPARATUS

[75] Inventors: Jürg Faas, Dinhard; Paul Stäheli, Wilen b. Wil; René Schmid, Niederneunforn; Ulf Schneider; Peter Anderegg, both of Winterthur; Robert Demuth, Nurensdorf; Jürg Koller, Pfyn; Martin Kyburz, Andelfinger, all of Switzerland

[73] Assignee: Maschinenfabrik Rieter AG, Winterthur, Switzerland

[21] Appl. No.: 723,235

[22] Filed: Jun. 28, 1991

Related U.S. Application Data

[63] Continuation-in-part of Ser. No. 673,303, Mar. 22, 1991.

[30] Foreign Application Priority Data

Jul. 2, 1990 [CH] Switzerland ..... 02193/90

[51] Int. Cl.[5] ..... D01G 9/08; D01G 9/16

[52] U.S. Cl. ..... 19/200; 19/205; 19/90; 19/95

[58] Field of Search ..... 19/55 R, 66 R, 66 CC, 19/85, 95, 107, 150, 200, 202, 205, 303; 209/23, 25, 270, 279, 284, 288; 406/173

[56] References Cited

U.S. PATENT DOCUMENTS

| | | | |
|---|---|---|---|
| 1,023,750 | 4/1912 | Morscher | 19/200 X |
| 4,407,047 | 10/1983 | Van Doorn et al. | 19/202 X |
| 4,547,935 | 10/1985 | Jagst | 19/200 X |
| 4,625,368 | 12/1986 | Leifeld | 19/85 X |
| 4,797,976 | 1/1990 | Leifeld et al. | 19/205 X |
| 4,964,196 | 10/1990 | Schmid et al. | 19/85 X |
| 4,969,237 | 11/1990 | Schmid | 19/85 X |
| 4,993,118 | 2/1991 | Schmid | 19/95 X |
| 5,033,166 | 7/1991 | Schmid et al. | 19/200 |

FOREIGN PATENT DOCUMENTS

| | | | |
|---|---|---|---|
| 0108229 | 5/1984 | European Pat. Off. . | |
| 0380936 | 8/1990 | European Pat. Off. | 19/97 |
| 2034774 | 1/1972 | Fed. Rep. of Germany . | |
| 1285072 | 1/1987 | U.S.S.R. | 19/202 |
| 1350196 | 11/1987 | U.S.S.R. | 19/202 |

*Primary Examiner*—Clifford D. Crowder
*Assistant Examiner*—Ismael Izaguirre
*Attorney, Agent, or Firm*—Burns, Doane, Swecker & Mathis

[57] ABSTRACT

A method for enabling the cleaning of fibers in a fiber cleaning machine in which a cleaning stream moves tufts around a rotating cleaning cylinder, the tufts being cleaned and opened. The cleaning action can be adapted to fibers of varying origin and to an increasing degree of opening in the course of cleaning. The cleaning stream is, to a large extent, controlled and controllable by decoupling it from the dynamic behavior of the transport streams which transport material to and away from the cleaning process. Compensation for variations in the cleaning stream, and in the material supplied for cleaning, are achieved by control of the cleaning intensity, in order that the tufts emerging from the cleaning process are constant and optimally cleaned and opened. The invention concerns also suitable fiber cleaning apparatus for the realization of the described method. The apparatus includes a cleaning cylinder positioned in a casing and a plurality of cleaning elements extending from the cylinder. The length, shape and density of the elements can change along the length of the cleaning cylinder so that the cleaning intensity varies along the length of the cylinder. Adjustable grid bars can be positioned below the cleaning cylinder.

35 Claims, 7 Drawing Sheets

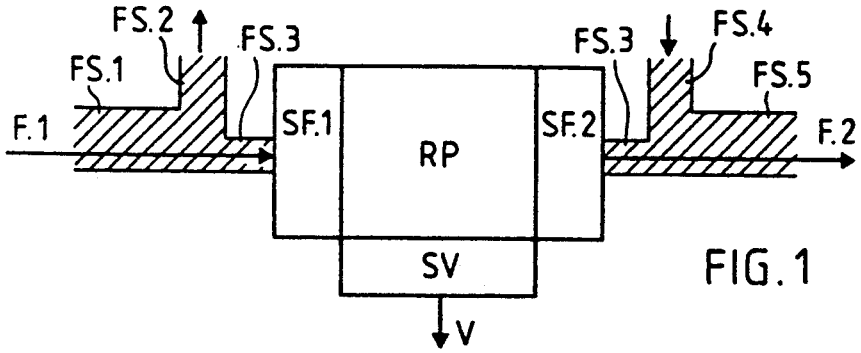
FIG. 1
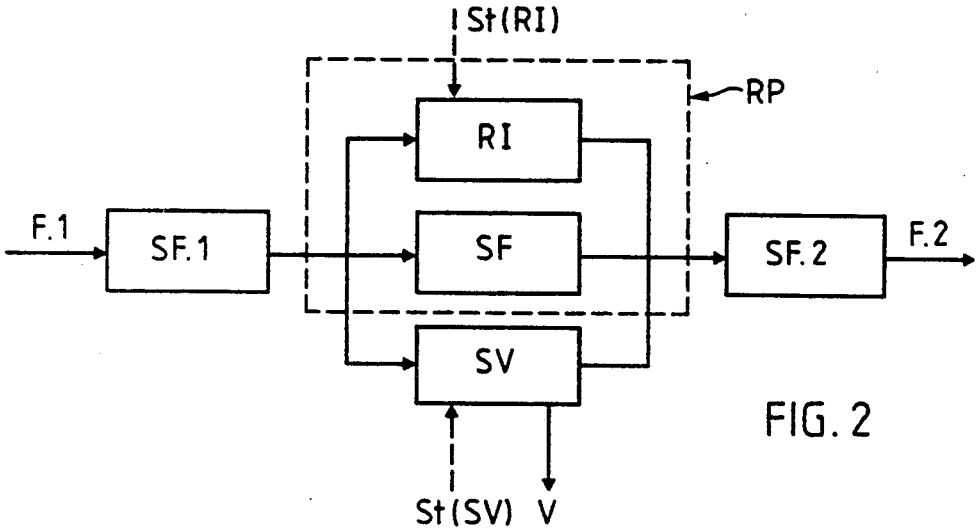
FIG. 2
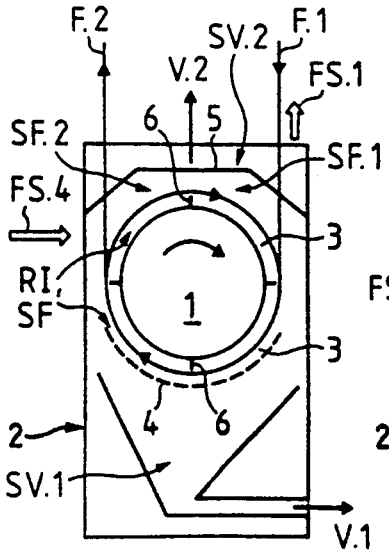
FIG 2.1a
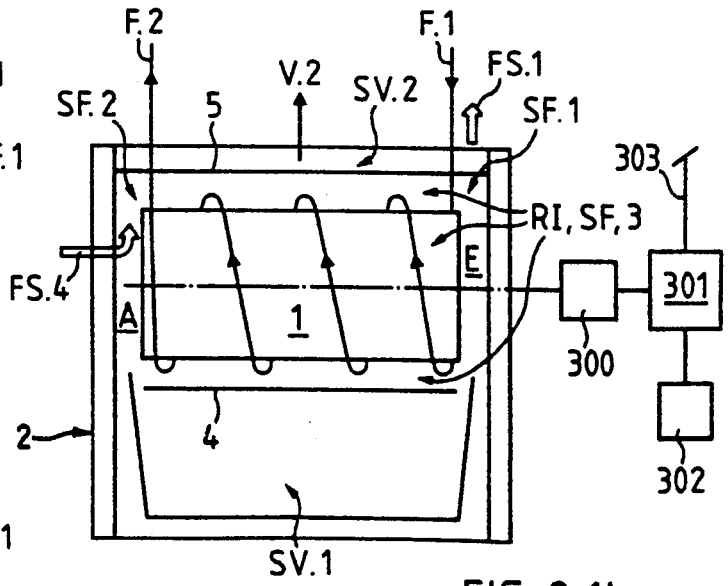
FIG 2.1b

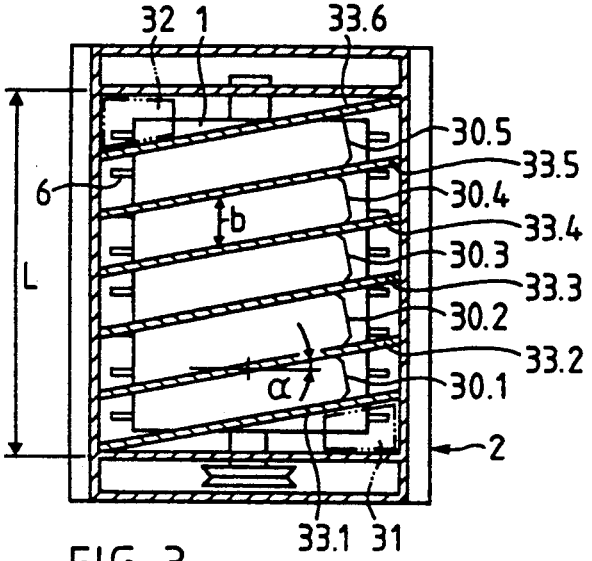
FIG. 3
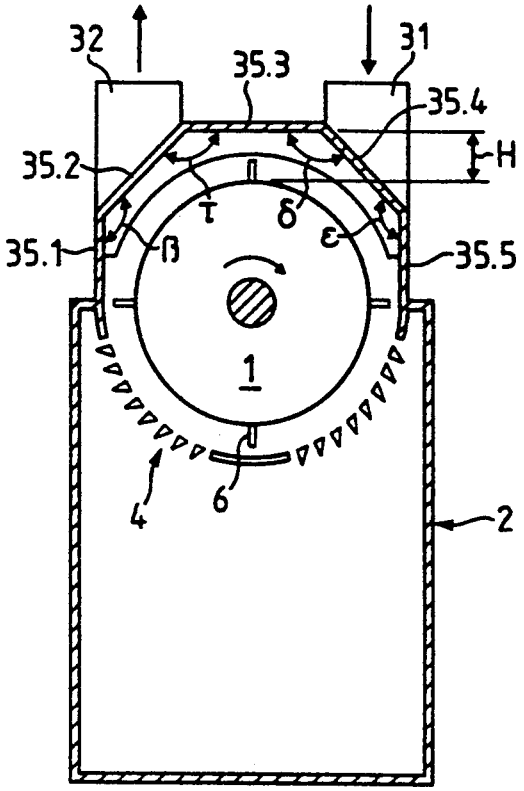
FIG. 3.1
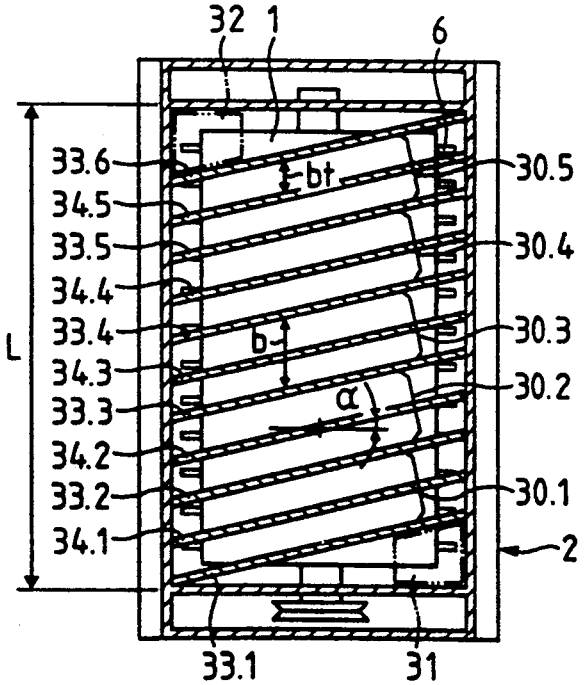
FIG. 3.2

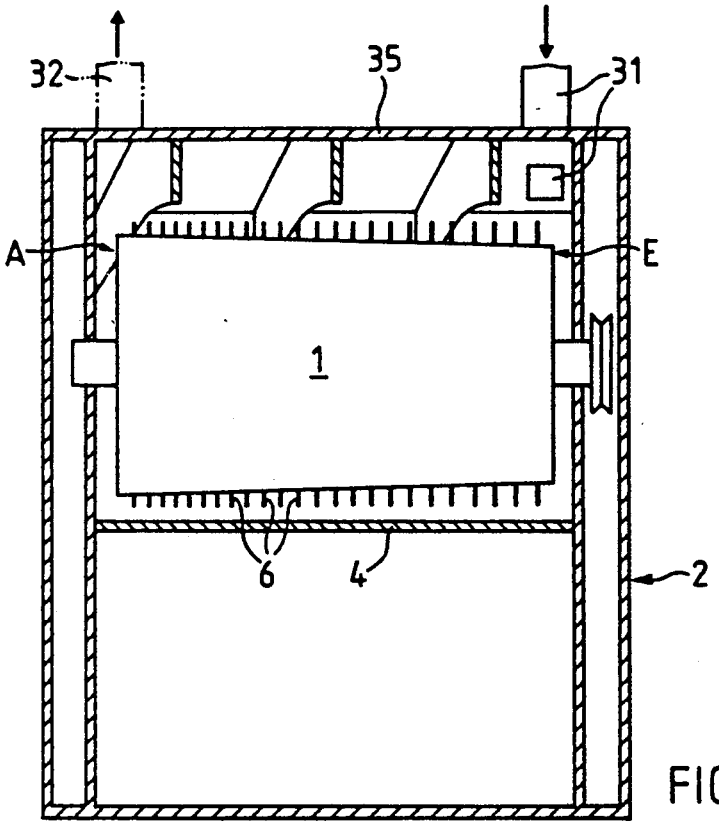
FIG. 4
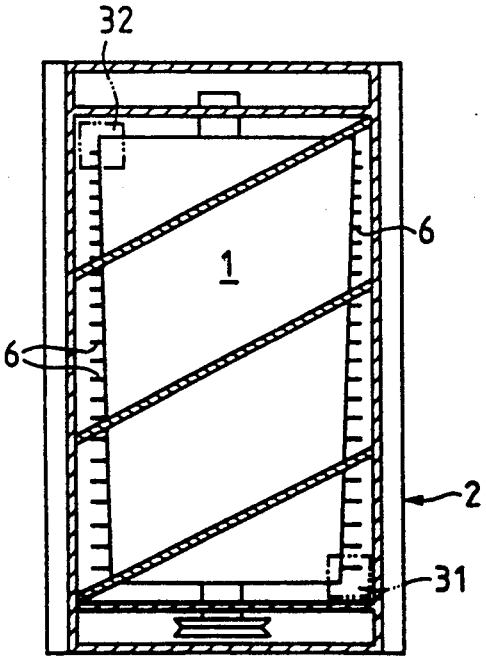
FIG 4.1
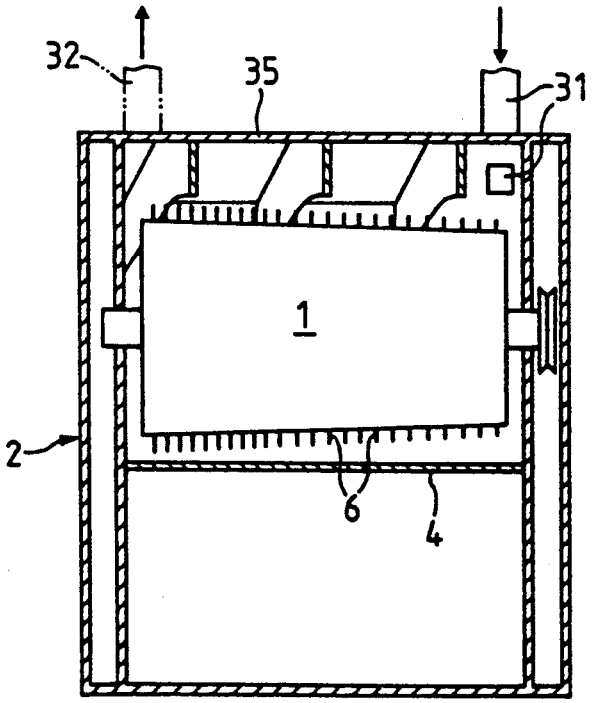
FIG 4.2

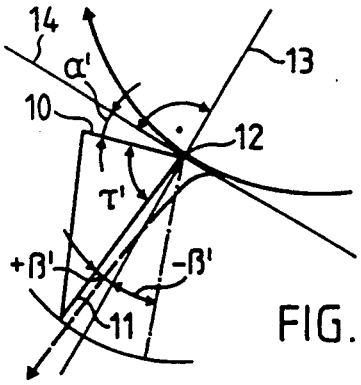
FIG. 5
FIG. 5.2
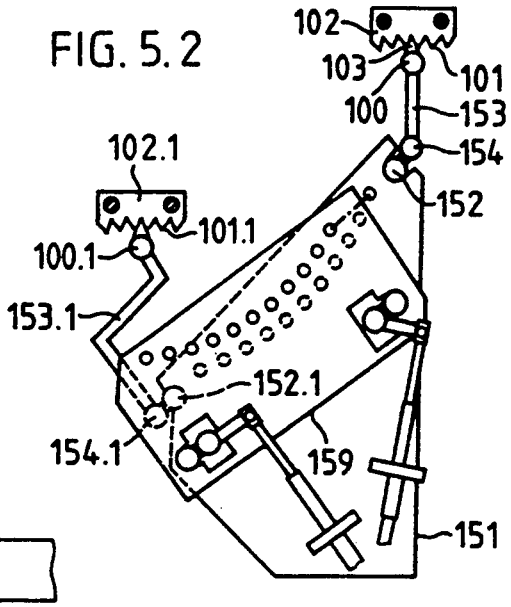
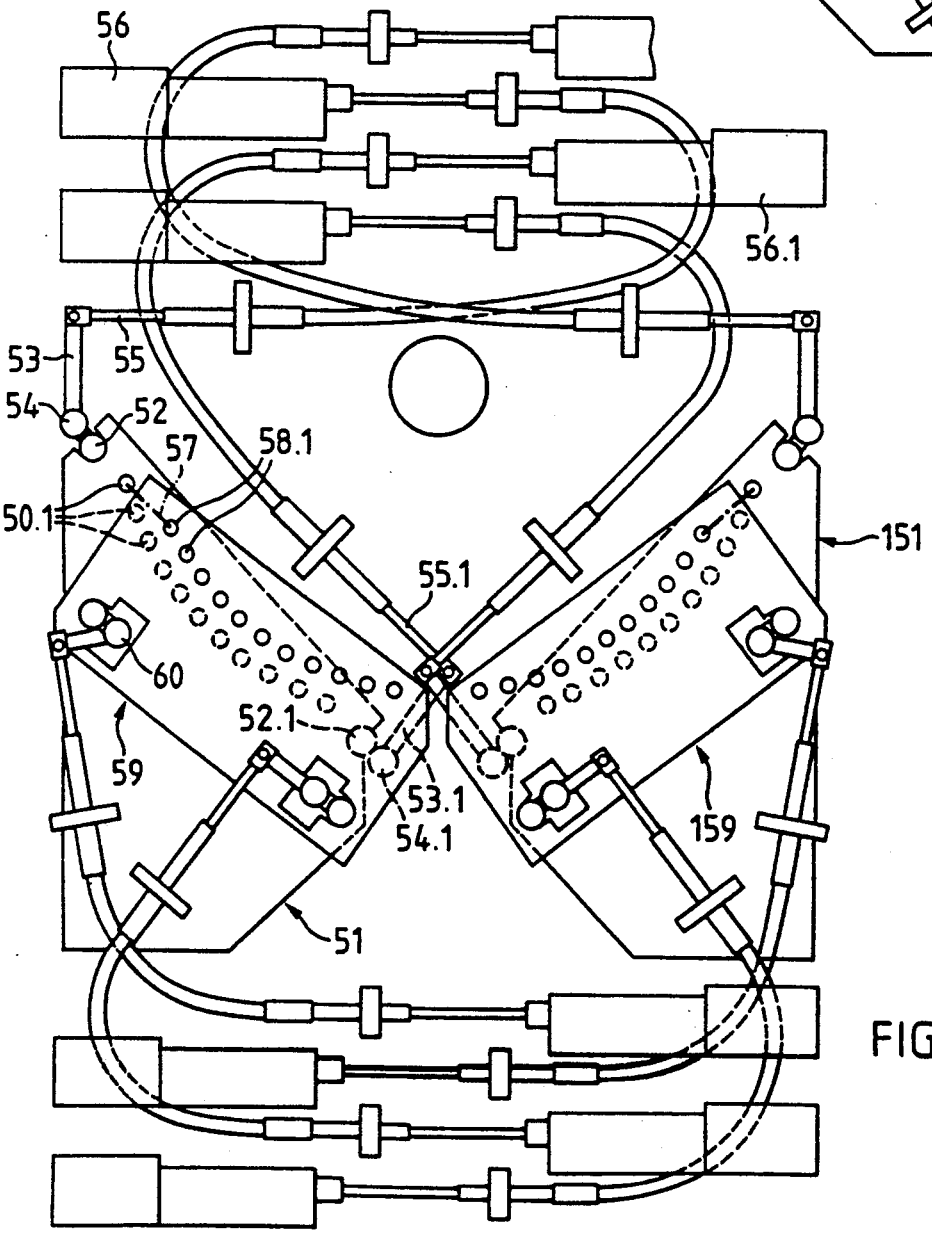
FIG. 5.1

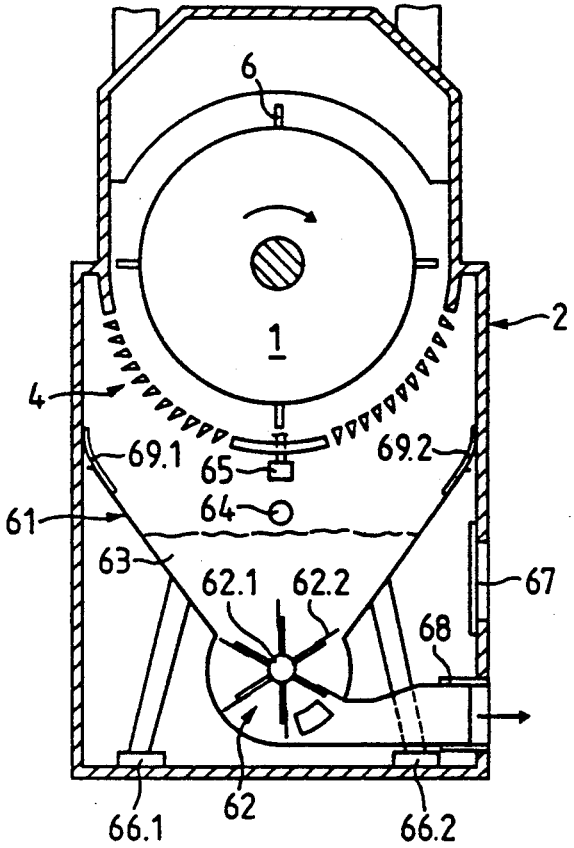
FIG. 6
FIG. 6.1
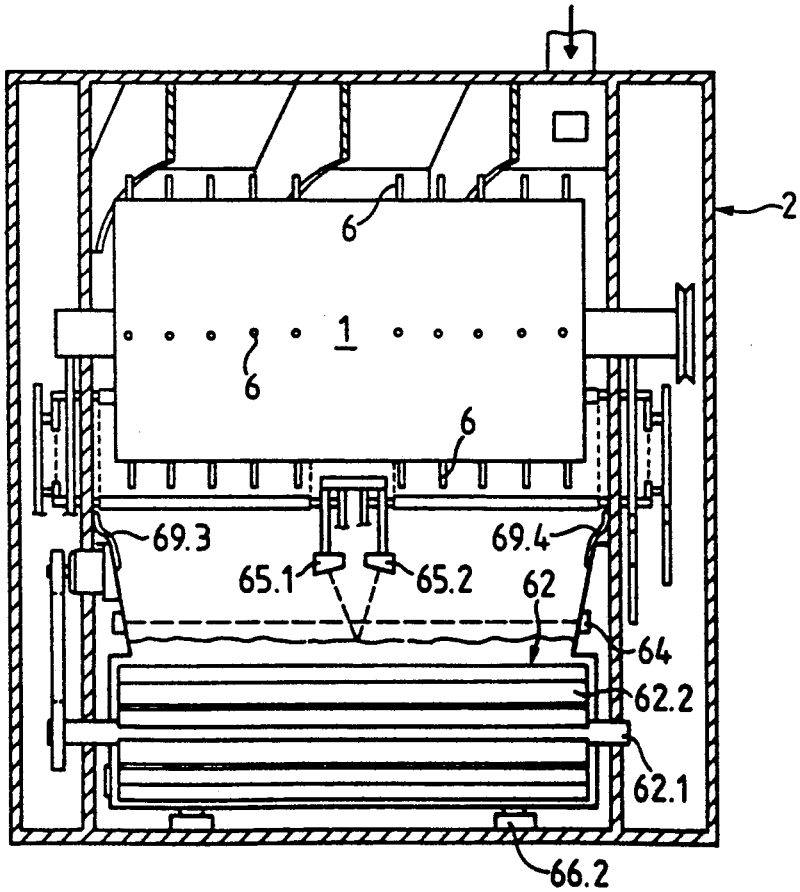

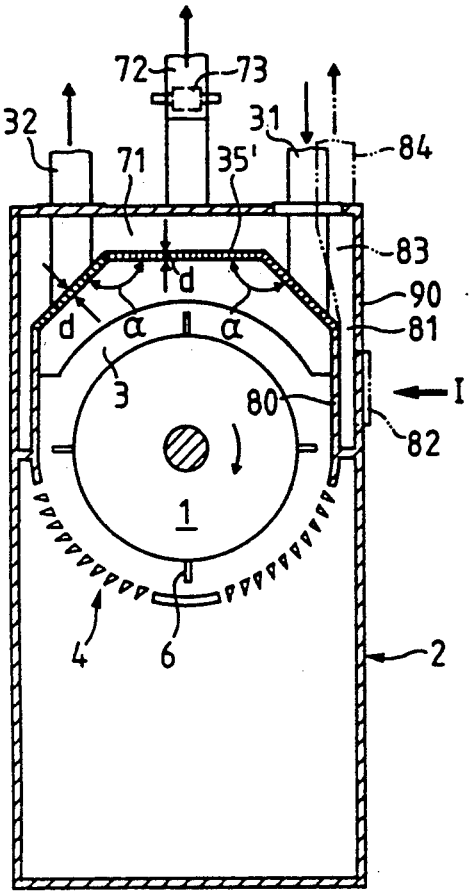
FIG. 7
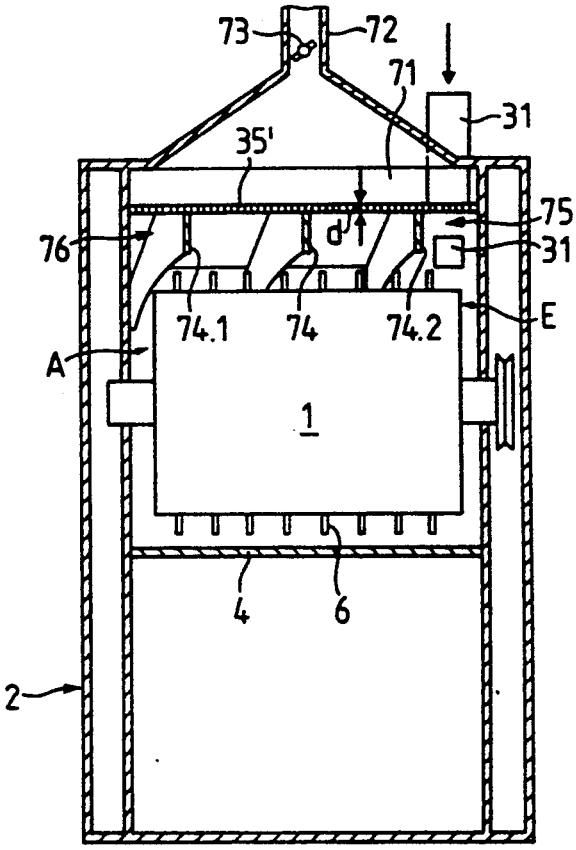
FIG. 7.1
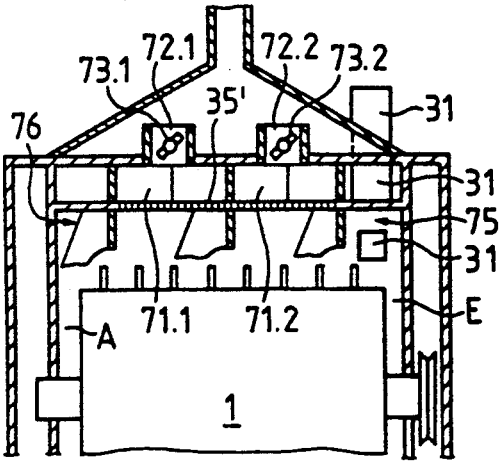
FIG. 7.2
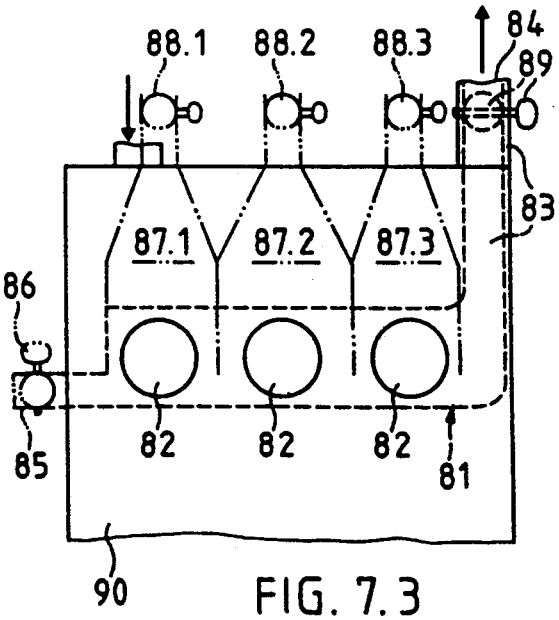
FIG. 7.3

ADJUSTABLE CLEANING OF FIBERS IN A SPIRALLED AIR PATH AND APPARATUS

The present application is a continuation-in-part of U.S. patent application Ser. No. 673,303 filed on Mar. 22, 1991.

FIELD OF THE INVENTION

The invention is in the field of textile technology. It relates to a method for cleaning cotton fibers and for guiding a clean fiber stream. The guiding of the fiber stream should on the one hand increase the process efficiency in terms of cleanliness and on the other decrease the disturbances in the stream.

The invention also relates to apparatus for carrying out the method. Preferably the apparatus increases the process intensity, elongates the process path (at the same machine dimensions) and decreases the disturbances inherent in the process. The term process relates to the procedures of cleaning, guiding clean-fiber and discharging impurities.

BACKGROUND OF THE INVENTION

Contemporarily, cotton fiber cleaning machines work as a rule in a pneumatic/mechanical manner by guiding the tufts in an air stream around a cylinder (cleaning and opening cylinder) which rotates around its axis and is equipped with mechanical cleaning elements. Simultaneously, the tufts are moved past stationary mechanical cleaning elements. The cotton fibers are supplied with pneumatic means, are brought to the cleaning elements and are transported away from them again. In the course of these events, the cotton fibers are cleaned with mechanical means. This interrelation of pneumatic and mechanical means can be controlled under certain conditions in the operation of the transporting pneumatic means. However, this has the disadvantage of mixing the transport function with the cleaning function, i.e. the jet of air with uncleaned fibers comes from one section in which the transporting function predominates into a section in which the cleaning function predominates and the transport function vanishes in a common process function until, in a subsequent section, it returns into the transport function.

SUMMARY OF THE INVENTION

It is a feature of the present invention that the transfer stations from one function to the next are of such nature that the transport does not disturb the intended process function of the cleaning stage, i.e. a disturbing effect deriving from the transport function can be "filtered out". This also goes for the transfer of the process function back into the transport function, as well as for the impurities discharge from the process function.

The process has an efficiency derived from the length of the treatment path for the fibers and the process intensity along this path. It is not critical for the process intensity to be consistent along the entire path, rather, it can decrease, increase or stay the same. In this manner a variable cleaning power (cleaning intensity) can be reached which can be more or less intensive depending on the origin of the materials.

The total task or total function which, according to an aspect of the invention, may be solved or mastered may have a number of single tasks in terms of method. These single tasks for the improvement of the opening and cleaning function of the tuft are as follows:

Means are provided for guiding the cleaning stream in the process section to enable an increase of the dwell time of the fiber materials in the process section.

Means are provided for adjusting the cleaning intensity or opening effect to the fibers and to the increasing degree of opening of the fibers to be cleaned.

Means are provided for fine adjusting of the cleaning intensity in order for example to change the cleaning intensity and the opening effect along the course of the procedure.

Discharge extraction chambers for the impurities output are arranged to "sieve out" the disturbances in such a way that an optimum cleaning procedure is maintained.

Inlet and outlet chambers for the process serve to "sieve out" disturbances and, where possible, also to aid cleaning by, e.g., collecting fine, dusty impurities from the fiber material.

BRIEF DESCRIPTION OF THE DRAWING FIGURES

Embodiments of the invention will now be discussed in detail with reference to the drawings, in which FIG. 1 is a schematic diagram of the cleaning process, indicating in block representations an input for the uncleaned fiber stream, an output for the cleaned fiber stream and a further output for impurities to be discharged.

FIG. 2 is a schematic representation of the cleaning process divided into procedure steps.

FIG. 2.1*a* is a schematic end view and

FIG. 2.1*b* is a schematic side view of a fiber cleaning machine as well as its drive, showing the locations of the process steps.

FIGS. 3 and 3.1 are plan and end views of a fiber cleaning machine showing measures for guiding the cleaning stream around the cylinder, and FIG. 3.2 is a view similar to FIG. 3.

FIGS. 4 and 4.1 are side and end views of a fiber cleaning machine showing measures for obtaining increased or decreased cleaning intensity in the cleaning effect, and FIG. 4.2 is a view similar to FIG. 4.

FIGS. 5 and 5.1 show measures for controlling the cleaning intensity in the cleaning stream during the cleaning process.

FIG. 5.2 is a partial view similar to FIG. 5.1 but showing a variant.

FIGS. 6 and 6.1 are end and side views of a fiber cleaning machine showing measures at the output of the impurities discharge in the lower part of the machine.

FIGS. 7 and 7.1 are end side views of a fiber cleaning machine showing measures at the output of the impurities discharge in the upper part of the machine and measures according to the invention for the inlet and outlet of the fibers, and FIG. 7.2 is a partial view similar to FIG. 7.1.

FIG. 7.3 shows a variant of the device of the FIGS. 7, 7.1 and 7.2.

FIGS. 8 to 11 show further measures in accordance with the invention for controlling the cleaning intensity in the cleaning stream and for controlling flow at the input and the output of the machine, with FIG. 8 being an elevational view of a fiber cleaning machine taken along the line 8—8 in FIG. 9, with FIG. 9 being an elevational view in the direction of the arrow I in FIG. 8, with FIG. 10 being a horizontal view looking down along the line 10—10 in FIG. 8, and with FIG. 11 being a sectional view along the line 11—11 in FIG. 10.

DETAILED DESCRIPTION OF THE PREFERRED EMBODIMENTS

Figure 8:
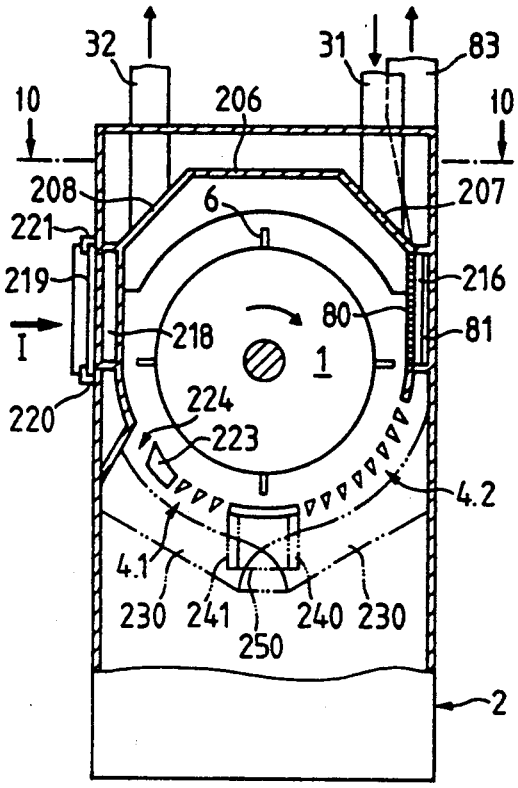
Figure 9:
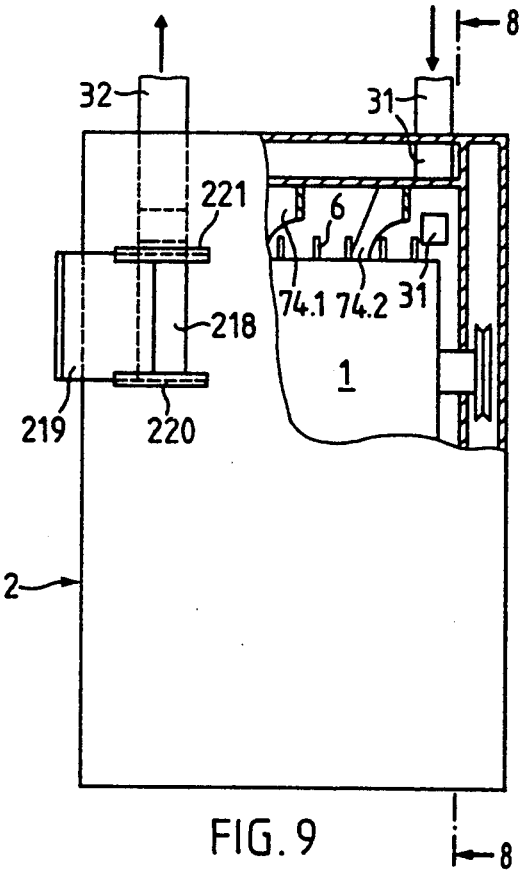

FIG. 1 provides a block diagram representation of the cleaning process. The box RP represents the cleaning process. It has an input F.1 for the uncleaned fibers, an output F.2 for the cleaned fibers and an output V for the impurities removed from the fibers during the process. These three intersecting points between box and surroundings are formed in such a way that the cleaning process in the box can go about without disturbances. For this the actual cleaning process RP is shielded off from the actual transport procedures for fibers and impurities in the later to be described "intersecting points measures" SF.1, SF.2 and sv.

Within the box RP a complex dynamic process is kept going which opens fiber tufts and separates fibers from impurities with the aid of kinetic energy, i.e. with acceleration changes. The tuft opening is of course a separation of the fibers making up the tufts. The cleaning procedures and the separation should not damage the fibers and hence the intensity is adjustable and controllable.

The process takes place in the following manner. The uncleaned fibers are transferred to a cleaning stream by a purely transporting stream, which has no other purpose than to get from one place to another laden with fibers. The cleaning stream should develop as many local lateral forces as possible in the tuft and these forces should be changeable in their sum along the entire length of the cleaning section. Subsequently, the fibers are transferred to an outgoing purely transporting stream. The cleaning stream should be open along its entire length for the continuous removal from the cleaning stream of particles in the form of impurities. The cleaning stream is formed by a part FS.3 of the incoming transport stream FS.1 and the cleaning stream becomes a part of the outgoing transport stream FS.5. There must be substantial balance between the inflowing and outflowing air from the cleaning stream. Disregarding loss (primarily the loss of air caused by the impurities discharge) nothing disappears in the box, i.e. FS.1=FS.2+FS.3 and FS.5=FS.3+FS.4, FS.2 being the part going into the atmosphere and FS.4 being the part coming from the atmosphere of the corresponding transport streams. See also FIGS. 2.1*a* and 2.1*b*. An important condition set for the operation is that the cleaning stream is not disturbed materially either by the transporting streams or by the continuous particle discharge.

The elements for the opening and cleaning of the tufts are e.g. fittings or picking pins on the cylinder, grid bars, grids, sieves, etc. There are known elements with a new arrangement to achieve an adjustable cleaning stream.

FIG. 2 shows the cleaning process as divided into single process steps. A material input F.1, two material outputs F.2 and V and two control inputs St can be seen. The control intervention ST(SV) influences the balance between the two material outputs F.2 and V. The control intervention St(RI) influences the cleaning intensity and at the same time the fiber opening and impairment. At the material input and at the material output, "intersecting point measures" (SF.1, SF.2 and SV) in accordance with the method are provided. In the main portion of the process, measures for the cleaning stream guidance (SF) and the cleaning intensity (RI) are provided according to the method. The cleaning process itself does not take place in the here represented form, of course, but rather in a simultaneous manner; a functional balance of all measures forms which can be altered by way of the control interventions.

FIGS. 2.1*a* and *b* again show the steps of method shown in FIG. 2. However, here the depiction of the method is in conjunction with the machine, which is represented for this purpose in a quite schematic way in section (FIG. 2.1*a*) vertical to the axis of the cleaning cylinder and in section (FIG. 2.1*b*) parallel to the axis of the cleaning cylinder. The fiber cleaning machine comprises a cleaning and an opening cylinder 1, which is turned in a casing 2 around a horizontal axis. The actual cleaning process takes place in cleaning space 3 which on the one hand is formed by the cylinder 1, and on the other by stationary cleaning elements 4 (e.g. cleaning rods arranged as grids below the cylinder) and by at least partially permeable walls over or next to the cylinder. Through this space the cleaning stream is guided around the cylinder 1 several times in a spiraling manner by corresponding measures SF. The stream is limited and guided by elements such as that designated by 5. The tufts are moved around the cylinder axis by transport and opening elements 6, e.g. picking pins, located on the surface of the cylinder and are contacted with stationary cleaning elements 4 protruding into the stream. The arrangement of all of these elements determines the swirling of the cleaning stream and hence the cleaning intensity, which comprise the procedure step RI. The fiber material is brought into the machine at the input end E of the cylinder 1 through an inlet chamber in which the intersecting point measures SF.1 in accordance with the method act upon the stream of fibers. At the outlet end A of the cylinder 1 the fiber material is brought out of the machine by way of a corresponding outlet chamber in which the intersecting point measures SF.2 in accordance with the method are acting. Discharge chambers for the discharge of the impurities are located below the cylinder 1 and above or next to it. In these two chambers intersecting point measurements SV.1 and SV.2 are active and make sure that the impurities streams V.1 and V.2 do not disturb the cleaning stream.

Consideration now will be given particularly to opening and cleaning enhancing guidance of the cleaning stream.

It has been found that the tufts which already have partially opened in the cleaning machine can at times collect and form fiber bunches again in the transfer chambers which are located above the cylinder and which have the function of directing the cleaning stream in a spiral manner around the cylinder. These reformed bunches then have to be opened again by the cylinder. Such disadvantages are avoided to a large extent by the guidance of the fibers in accordance with the invention into the transfer chambers. This guidance is determined by the limiting of the transfer chambers in axial and in radial direction in accordance with the invention.

The axial limiting of the transfer chambers is accomplished by the guiding means whose number determines the number of transfer chambers and hence the number of revolutions of the fiber material around the cylinder. Referring to FIGS. 3 and 3.2, with a greater number of transfer chambers the angle of inclination alpha, (defined by the guiding means, e.g. guiding plates, and a plane at right angles to the axis of the cylinder), decreases. It has been shown that with a decreasing angle of inclination the tendency of forming bunches in the transfer chambers decreases. However, in order to even enable a transport in axial direction, the angle of inclination should not be chosen too low. With a greater number of transfer chambers (in the case of a cylinder of a certain suitable length) the axial width bt of each transfer chamber decreases which also inhibits the gathering of greater amounts of tuft fibers in the transfer chambers. In FIG. 3.2, the width b corresponds to the axial lift per rotation of the material around the cylinder 1 and the width bt corresponds to the width of a transfer chamber, the width bt being chosen as a value between 1/1 and 1/5 of the width b depending on the angle of inclination $\alpha$ and the diameter of the cylinder.

With long cylinders the transfer chambers may be wider than the optimum even when using the minimum angle of inclination that still will deliver good streaming properties. It is advantageous in such cases that at least one additional parallel guiding means be mounted within the transfer chambers. These separate the cleaning stream into two (or more) partial streams of a width bt closer to the optimum.

With the application of such means the cleaning stream can be brought into a screw-like path whose limiting means aid the opening and cleaning process. Such means enable a variable (e.g. increased) dwell time (by way of a longer cleaning path) of the material to be cleaned in the cleaning stream and thereby lead to enhanced cleaning.

The radial extent of the transfer chambers determines the width of the cleaning space above the cylinder, the "width of the cleaning space" being generally understood as the radial distance between the surface of the cylinder (from which the beating elements protrude) and a wall at a distance therefrom, which together limit the "width" of the cleaning stream. This distance and its geometric form also influence the streaming properties in the transfer chambers.

FIGS. 3, 3.1 and 3.2 correspond to FIGS. 2, 1 and 3, of Swiss patent application CH-00319/89-2 and U.S. Pat. No. 4,969,237. They show schematically an exemplary fiber cleaning machine in top view without a cover and in a section vertical to the axis of the cylinder as well as a further embodiment of the same machine also in top view without a cover. The illustrated machine in principle corresponds to that represented in FIG. 2.1. In all of these Figures the transfer chambers (and the surfaces which define them) which lead the cleaning stream over the upper part of the cylinder are visible.

The transfer chambers 30.1, 30.2, 30.3, 30.4 and 30.5 (FIG. 3), which extend between an input muff 31 and an output muff 32, are axially defined by guiding means 33.1, 33.2, 33.3, 33.4 33.5 and 33.6, whose number per given length L determines the angle of inclination alpha and the breadth b of the transfer chambers. The angle of inclination can be between 8 and 30 degrees, for example, and it is advantageously chosen to be between 15 and 20 degrees. FIG. 3.2 shows an embodiment with a longer cylinder which comprises the intermediate guiding means 34.1, 34.2, 34.3, 34.4, and 34.5 between the guiding means 33.1–6. By this means the effective chamber width b (whole guide chamber, corresponds to said lift b) is reduced to bt in accordance with said division.

The guide chambers are radially limited by the cover 35, which advantageously consists of several (e.g. five) cover plates 35.1, 35.2, 35.3, 35.4 and 35.5. The two outer plates 35.1 and 35.5 may stand vertical and the three in the middle 35.2–4 may be arranged in the form of a terrace roof. The dull angles $\beta$, $\epsilon$, $\gamma$, $\delta$ between the cover plates can be in the range of 120 to 149 degrees, and the uppermost cover plate 35.3 can have a distance H to the surface of the cylinder. This distance H may be in the range of 1/12 to 1/5 of the diameter of the cylinder. Such a radial limitation of the guide chambers results in a predetermined air passage adjusted to yield the tuft guidance advantage that the tuft is guided without bunching and with a desired impacting against the cover walls to ensure that the tuft is turned. At a diameter D of the cylinder of 650 mm, e.g., and a diameter of the beat circle DS of 750 mm, an angle alpha of 18 degrees, a width bt of 80 mm and a height H of 175 mm is chosen.

FIGS. 3, 3.1 and 3.2 and the corresponding descriptions of the guide chambers and their limiting means convey only a schematic illustration of part of the installation having the function of guiding the cleaning stream in a spiral form around the cleaning cylinder and thereby both achieving as much opening of the tuft as possible and aiding the cleaning as a whole in an optimum manner. Details and further exemplary embodiments may be understood by reference to Swiss patent application No. 00 319/89-2 and U.S. Pat. No. 4,969,237, the entire disclosures of which are incorporated herein by reference.

It will be useful to turn now to a consideration of adapting the cleaning intensity to the fiber material and to the degree of opening which changes along the cleaning path (procedure step RI).

The cleaning and opening effect, and also the intensity of the described cleaning process, are dependent on a number of factors. These include not only the width of the cleaning space and the depth of penetration into the tuft stream of the mechanical cleaning elements fixed to the cylinder (i.e. on the ratio of the length of the cleaning element to the cleaning space width), but also on the thickness, form and density of the cleaning elements. The optimum cleaning and opening effect, besides the properties of the fiber material to be cleaned, is heavily dependent of the degree of opening of the tuft. However, given that this opening degree increases continuously within the cleaning machine between the input end and the output end of the cylinder, it is advantageous to change the cleaning and opening effect along the cylinder length correspondingly, e.g. by changing (continuously or in steps between the input and the output end of the cylinder) the diameter of the cylinder and/or the length, the thickness, the form and/or the density of the cleaning elements fixed to the cylinder.

Just as the cleaning intensity is dependent on the length, thickness, density and form of the cleaning elements on the cylinder, it is also dependent on the same parameters of the stationary cleaning elements below the cylinder. A part of these parameters for an optimum cleaning process are controllable, i.e. they can be adjusted also with the machine running, and will therefore be described in the next section as "controllable cleaning intensity".

FIGS. 4, 4.1 and 4.2 correspond to FIGS. 3, 2 and 7 of Swiss patent application CH 00 320/89-9 and U.S. Pat. No. 5,018,247. FIGS. 4, and 4.1 show schematically an exemplary fiber cleaning machine in section parallel to the axis of the cylinder and in top view after removal of the cover, and FIG. 4.2 shows a further embodiment also in section parallel to the axis of the cylinder. In both of these embodiments the cylinder has a variable diameter along its length and the cleaning elements attached to the cylinder have various lengths.

The stream of tufts is guided into the machine through the input muff 31 at the input end E of the cylinder 1 and leaves it again through the output muff 32 at the output end A of the cylinder 1. The cleaning space is formed by the outer surface of the cylinder 1 and by the cover 35 (see also FIG. 3) above the cylinder 1 and the stationary cleaning elements 4 below the cylinder 1. The width of the cleaning space narrows from the input end E of the cylinder towards the output end A, because the diameter of the cylinder increases while the means 4 and 35 are arranged parallel to the cylinder axis. The embodiments illustrated in FIGS. 4 and 4.1 are equipped with cleaning elements in the form of beating pins 6 which become shorter from the input end towards the output end and whose density does not vary. Given that the penetration depth of the cleaning elements and the cleaning space decrease along the entire length of the cylinder, while the density and thickness and form of the cleaning elements remains the same, the aggressiveness of the cleaning and opening might stay approximately constant along the length of the cylinder. The penetration depth of the cleaning elements is to be understood as the percentage of the length of the beating pins which grips the tuft and accelerates it, this depth not being possible to be derived exactly but having to be estimated.

The embodiment represented in illustration 4.2 causes a clearly increasing intensity between the input end E of the cylinder 1 and the output end A. The space width decreases in the manner represented in FIGS. 4 and 4.1, but the length and (optionally also) the density of the cleaning elements clearly increases. If, there is also a decrease in the thickness of the cleaning elements and their form changes correspondingly, all these changes together cause an increase of the intensity of the opening and cleaning effect between input end E of the cylinder and output end A.

The embodiment illustrated in FIG. 4.2 is especially suited for long-fiber cotton which must be treated very gently in an early stage of the operation, because a great danger of nep formation exists at this stage but decreases with continued opening.

Typical exemplary measurements for the components of a desirable system may be the following: cylinder length 1.6 m; cylinder diameter at input end 65 cm; cylinder diameter at output end 70 cm; length of the cleaning elements at the input end 5 cm and at the output end 2.5 cm; thickness of the cleaning elements at the input end 1.2 cm and at the output end 0.8 cm; and distance between the neighboring cleaning elements at the input end 3 cm, and at the output end 2 cm.

While FIGS. 4, 4.1 and 4.2 and the corresponding description disclose apparatus which has the function of adjusting the cleaning process to the fiber material to be cleaned and to an increasing degree of tuft opening along the length of the cylinder, for details and further exemplary embodiments reference may be had to patent application No. 00 320/89-2 and U.S. Pat. No. 5,018,247, the entire disclosures of which are incorporated herein by reference.

It will be useful now to consider particularly the matter of controllable cleaning intensity (procedure step RI).

Adjusting the cleaning and opening effect of the machine may be accomplished not only by the type of changes in the cylinder and the cleaning elements which have been described above, but also by adjustment of the stationary cleaning elements below the cylinder. These cleaning elements can be grid bars arranged in groups with a triangular cross section. Variable parameters are the width of the cleaning space (i.e., the distance between the cylinder and the cleaning elements), the number of cleaning elements along the cleaning path and their form protruding into the tuft stream. Further adaption of the cleaning operation to the tuft material to be cleaned can be effected through selection of the number, form and positions of the grid bars disposed in cooperating relation to the cylinder.

Improved adaption of the cleaning effect to particular textile fiber materials can be achieved through variable adjustment of at least some of the grid bars relative to the cylinder in order to change the distances between the grid bar and the cylinder and/or only the positions of the grid bars in relation to the cylinder. For this, each of the grid bars is slewable or pivotable around an axis parallel to its longitudinal axis. The two axial ends of the grid bars can also be variously adjustable in relation to the cylinder. Further, in a group of grid bars placed adjacent to the periphery of the cylinder, the grid bars at one end of a group (seen in peripheral direction) may be differently adjustable in relation to the cylinder and possibly also differently slewable than the grid bars at the other end of the group. Such an arrangement enables not only a finer adjustment but also an adjustment (at least concerning the position of the grid bars) which may be done without modification of the machine, and indeed even during its operation.

FIGS. 5 and 5.1 compound generally to FIGS. 4 and 3 of Swiss patent application 321/89-0 and U.S. Pat. No,. 4,993,1218. FIG. 5 shows a cross section of a grid bar to illustrate the effect of its slewable motion in relation to the cylinder and the tuft stream, and FIG. 5.1 shows an exemplary apparatus for the proper adjustment of the grid bars in a fiber cleaning machine for controlling the cleaning intensity.

FIG. 5 indicates how cleaning properties of a grid bar with an approximately triangular cross section may be changed by slewing the grid bar around its axis. The grid bar has an edge 12 facing the tuft stream (drawn arrow). This edge 12 is defined by a free surface 10 and an adjusting surface 11, and it includes a wedge angle $\tau$. An adjusting angle $\beta$ is defined by the adjusting surface 11 and a radial line 13 intersecting the cutting edge 12 and the axis of the cylinder (not included in the Figure). A free angle $\alpha'$ is defined by the free surface 10 and a tangential line 14 which intersects the radial line at right angles at the location of the cutting edge 12. The free angle $\alpha'$ generally will be between 0° (i.e. when the free surface 10 lies on the tangential surface 14) and 30°. The wedge angle $\tau'$ is given by the cross section of the grid bar. The free angle $\alpha'$ and the adjusting angle $\beta'$ can be changed by slewing the grid bar.

Each stationary cleaning element, as represented in cross section in FIG. 5, separates an impurities stream (dashed line) from the cleaning stream (drawn line). Optimum separation is reached when as many impurities as possible have already collected at the lower side of the cleaning stream by way of the centrifugal force and gravitation and when as little as possible fiber tuft material reaches the impurities stream and when as few as possible of the tufts are damaged at the cutting edge 12. The relation between these criteria for various fibers with various degrees of impurities is complex and must be derived empirically. For this reason it is advantageous to have a capability for making at least some adjustments of the parameters during the operation of the fiber cleaning machine.

The grid bars can, e.g., be arranged in four groups, with two groups arranged adjacently around the lower peripheral part of the cylinder and two groups above the cylinder length, with one following the other.

FIG. 5.1 represents an exemplary device for the adjustment of the distance to the cylinder and the slewing position of the grid bars of two such groups of grid bars arranged one next to the other in peripheral manner. A similar device is connected to the opposite ends of the grid bars, and the adjusting of the distance to the cylinder is preferably accomplished independently at the two ends so that, along the length of the cylinder, the distance can be adjusted to be constant or increasing or decreasing.

The device is represented in a view where the grid bars are to be imagined as protruding out from the back of the paper. The device consists of two part installations of which each is allocated to a group of grid bars. In the following description only the part installation at the left in FIG. 5.1 will be dealt with, but everything also holds for the right part installation. The ends of the grid bars (the group comprises for example 11 grid bars) are placed in holes 50.1 of a distance control plate 51. The distance control plate 51 is adjustable in relation to the machine frame and in relation to the cleaning cylinder by two adjustment installations which can be actuated independently from each other. Each adjustment installation consists of a two-armed lever (52 and 53 or 52.1 and 53.1) pivotable or slewable around an axis 54 or 54.1 fixed with respect to the frame. The lever arm 52 or 52.1 grips into a recess in the distance control plate 51 while the other end of the lever arm 53 or 53.1 is attached to a Bowden pull cable 55 or 55.1. The other end of the Bowden cable 55 or 55.1 is actuated by a linear motor 56 or 56.1 fastened to the frame.

Instead of the adjustment by the linear motors the adjustment may take place manually, if there exists no necessity to adjust the plate 51 by remote control. An example of a manual adjustment is shown in FIG. 5.2 which represents on a smaller scale a distance control plate 151 and an angle control plate 159 similar to the plates at the right half of FIG. 5.1. The distance control plate 151 in FIG. 5.2 is adjusted by the levers 152 and 153, which are slewable around a fixed axis 154, as well as by the levers 152.1 and 153.1 which, are slewable around the fixed axis 154.1, i.e. adjustable in the same measure as the before described distance control plate 51.

Lever 153 has a manual grip 100 for the manual slewing of the lever 153 and 152. The grip 100 is equipped with a tooth 103 which cooperates with notches 101 in a stationary toothed element 102 for the lever 153 in the position to which it is moved by manipulation of the grip 100. In order for the tooth 103 to grip into the adjacent notches, the lever 153 may be made of spring steel, so that with the aid of the grip 100 the tooth 103 can be lifted out of the notches 101 when the lever 153 is to be pivoted.

Similar means are provided for the levers 153.1 and 152.1 on the left side (as seen from FIG. 5.2) of the distance control plate 151. A grip 100.1 carries a tooth which cooperates with notches 101.1 in a stationary toothed element 102.1.

The angle control plate 159 is adjustable in the same manner as the angle control plate 59 of FIG. 5.1. There also exists the possibility however to execute this adjustment manually by removing the bowden pull cables and fastening the corresponding levers in their selected positions by means of a notch system like the one just described for operating the levers 153 and 153.1.

The ends of the grid bars are each linked via a crank arm 57 (only hinted at in FIG. 5.1 by a dotted line at the first grid bar) via a cog 58.1 to a common angle control plate 59. The angle control plate 59 is adjustable in relation to the distance control plate 51 by two independent adjustment installations which are similar to the adjustment installations for the distance control plates 51. However, the axes (e.g. 60) of the two-armed levers are fixed on the distance control plate 51.

Such an installation for adjusting the distance from the grid bars to the cylinder and pivoting the grid bars about their axes enables adjustment of the distance to the cylinder to be made on a grid bar to grid bar basis within the group. Furthermore, the arrangement enables adjustment of the angular positions of the grid bars from grid bar to grid bar within the group.

While FIGS. 5 and 5.1 and the corresponding description of the control device for the stationary cleaning elements disclose apparatus which has the function of controlling the intensity of the cleaning process during the operation of the fiber cleaning machine, details and further exemplary embodiments are disclosed in Swiss patent application No. 00 321/89-0 and in U.S. patent application Ser. No. 07/471,515 now U.S. Pat. No. 4,993,118, the disclosures of which are incorporated herein by reference in their entireties.

It is appropriate to turn now to consideration of a disturbance-free discharge system for the impurities located in the lower part of the machine (procedure step SV.1).

In cleaning machines tufts are primarily opened so that the fiber collections become increasingly smaller, with loosely stored foreign particles separating and dropping out to be transported away as wastage. Separation takes place by way of a plucking or beating process which takes place by means of rapidly revolving toothed cylinders and beating pins. This rapid rotation, together with the incoming and outgoing streams, cause dynamically produced air streams (turbulences) which are also included in the cleaning process. Depending on the system and the adjustment, an amount of clean fibers can be eliminated from the process together with the foreign particles and must undergo a recycling.

It is not desirable for the cleaning process to be influenced by the discharge of the wastage which is required from time to time. Hence, apparatus is provided which lowers the amount of clean fibers discharged with the waste particles discharge in that the discharge procedure for the dirt particles is controlled in such a way that only controlled amounts of clean fibers are eliminated with the particles.

The space underneath the cylinder of the fiber cleaning machine comprises according to the state of the art a collecting trough in which the impurities are separated by the stationary cleaning elements are collected. During the disposal of the wastage a pressure difference must be overcome without essentially influencing the streaming relations in the upper part of the cleaning machine. If, for example, the machine were opened to discharge the wastage, it would cause a sudden difference in pressure which would extend into the cleaning stream and disturb its course. This disturbance would then effect a disturbance of the main stream at the grid bars so that tufts which should have been conveyed into the tuft exit would instead fall into the collecting trough.

Therefore, it is desirable that the impurities discharge take place in such a way that the stable pressure conditions in the operation are kept essentially constant. In order to do this a part of the material of the discharge is used as a stream buffer filter.

The aerodynamic disturbance of the cleaning stream does not take place because of the difference which exists from the side with the higher pressure to the side with the lower pressure, but by its dynamics, i.e. its acceleration and its flowing speed. Therefore it must be tried to make the dynamics of this disturbance smaller in comparison to the dynamics of the cleaning process in a negligible manner. Hence, is the false air dynamics kept correspondingly low, in illustration in the form of a soft running bell pulse instead of a rectangular impulse, then the disturbance is essentially lower. The relatively light, somewhat fluffy wastage is compressed lightly and over a short time to a filter mat by way of the false air stream in the direction of the output, so that the false air stream is delayed in terms of time. This leads to the desired buffer effect.

In terms of method this is achieved by collecting the wastage in a collecting trough until it has reached a certain operable layer thickness. A partial discharge of the wastage then takes place in such a way that one protective layer always remains between the upper space in which the cleaning takes place and the discharge gate which leads outwards. Hence, discharge only takes place once a certain filling level has been reached and then only in an amount to leave a predetermined level of material in place. With these criteria a protective layer for the quasi-maintenance of the pressure difference is formed and maintained. The discharge takes place with a gate wheel and a cooperating pneumatic means.

FIGS. 6 and 6.1 correspond to FIGS. 3 and 4 of Swiss patent application CH-002613/89 and U.S. Pat. No. 5,033,166. FIG. 6 shows schematically an exemplary fiber cleaning machine in a section perpendicular to the axis of the cylinder, and FIG. 6.1 is a section parallel to the axis of the cylinder. In the lower part of the cleaning machine means for the discharge of the impurities can be seen. The task of such means is to discharge from the machine the impurities separated in the cleaning process in such a way that the cleaning stream is not (or only minimally) disturbed.

The installation comprises a trim tank 61 with a gate wheel 62 in the form of revolving plates, i.e. with a drive axis 62.1 with wing-like plates 62.2. For each partial rotation of the gate wheel a determined part of the total wastage is separated which brings about a sinking of the filling level. The layer still on top 63 suffices however to buffer the possible pressure difference referred to above, and in a continuous cleaning process the filter layer is built up again by waste falling down through the grid bars 4. This discharge/buildup process is controlled with weight and/or filling level sensors (64, 65.1, 65.2, 66.1, 66.2) which have been represented in the Figure only schematically. A simple variant exists in that the gate wheel is simply turned on periodically by a clock switch for a predetermined portion of a rotation or portion of rotations. Furthermore, additional means 67, 68 and 69.1–4 are provided in order to prevent an undesired pressure compensation or a pressure turnaround. These means are as a rule sealing means which have the effect of one-way valves.

While FIGS. 6 and 6.1 and the corresponding description disclose apparatus which has the function of minimizing disturbances of the cleaning stream during discharge from the lower part of the cleaning machine of impurities which have been separated from the tufts, details and further exemplary embodiments are disclosed in Swiss patent application No. 00 2613/89 and in U.S. application Ser. No. 07/551,327 now U.S. Pat. No. 5,033,166, the disclosures of which are incorporated herein by reference in their entireties.

Attention now will be directed to provisions for obtaining a disturbance-free discharge of impurities in the upper part of the machine and disturbance-free and cleaning-enhancing input and output of the fiber material (procedure steps SV.1, SF.1 and SF.2).

The material eliminated by passing between the stationary cleaning elements 4 consist primarily of heavy impurities as indicated in the discussion above concerning the discharge of impurities from the lower part of the machine. Additionally, light, dust-like impurities can be eliminated from the upper parts of suitably equipped machines. Such machines have (at least partially) air and dust permeable covers for the transfer chambers and an overlying hood contains at least one low-pressure chamber connected to a suction line. Through the air and dust permeable covers of the transfer chambers air can be sucked out of the transfer chambers along with very light, dusty particles, thereby eliminating such matter from the cleaning stream transporting the fiber material.

The air and dust permeable cover of the transfer chambers may be a sieve or a perforated sheet with holes of a diameter of approximately 1.5 mm. The perforated sheet can form at least part of the cover of a transfer chamber or a predetermined number of chambers. Such permeable chamber walls act as baffles, just like the cleaning elements. On them not only are fine particles eliminated but also lateral forces are also exerted on the cleaning stream. At the holes a number of defined local air streams form, of which some are directed in the general direction of the cleaning stream and the others in the general direction of the suction stream. The low-pressure chamber (or low-pressure chambers) which has been allocated above the permeable cover and from which the air laden with dust is sucked out serves as a buffer between the effective suction and the cleaning stream. In this chamber the air speed is relatively low compared to that in the cleaning stream, i.e. only high enough to transport the eliminated dust particles away. Hence possible dynamic variations of the chamber streams have only a minimal influence on the dynamics of the cleaning stream. Advantageously, the low-pressure chamber is provided with a throttling organ at its suction connection.

In the same area of the cleaning machine there are the inlet and outlet chambers by way of which the tuft stream enters and leaves the machine. The air stream which introduces the tufts as a purely transporting stream into the fiber cleaning machine should be guided in such a way that the cleaning stream within the machine is not disturbed by it.

FIGS. 7, 7.1 and 7.2 correspond generally to FIGS. 1, 3 and 4 of Swiss patent application CH-00242/89 and U.S. Pat. No. 4,964,196. FIG. 7 shows schematically an exemplary fiber cleaning machine in a section perpendicular to the axis of the cylinder, and FIGS. 7.1 and 7.2 show two embodiments in section parallel to the axis of the cylinder. In all these views the transfer chambers as well as the inlet and outlet chambers can be seen in the upper part of the figures.

The cleaning space 3 above the cylinder is limited by the cover 35' which is at least partially permeable for air and impurities. Above this cover the low-pressure chamber 71 is located which is divided into an low-pressure chamber 71.1 and 71.2 above each transfer chamber according to this embodiment in FIG. 7.2. A suction line 72 is connected to the low-pressure chamber (two suction lines 72.1 and 72.2 for the embodiment according to FIG. 7.2) into which a throttle valve 73 (or 73.1 and 73.2), e.g. an adjustable throttle flap, is fitted and which is connected to a suction installation which is not illustrated.

The air stream which transports the tuft as a purely transporting stream reaches the machine through the input muff 31 fixed to the input end E of the cylinder and becomes the cleaning stream where the input muff 31 breaks through the cover 35'. The cleaning stream becomes a purely transporting stream at the corresponding place at the outgoing end A of the cylinder where the output muff 32 breaks through the cover 35'. The stream leaves the machine with the cleaned fiber material through the output muff 32. Input and output muffs (31, 32) are arranged in such a way that the transporting stream reaches the cleaning space tangentially to the cylinder and leaves it tangentially again.

The inlet chamber 75 and the outlet chamber 76, in which the procedural steps SF.1 and SF.2 operate, are hence limited on the side by a first and a last guiding means 74.2 or 74.1 in transporting direction as well as by the outer wall on the side of the cleaning machine. On the top they are limited just like the transfer chambers by the cover 35' which may be air and dust permeable at these places according to FIG. 7.1 (FIG. 7.2).

While FIGS. 7 and 7.1 and the corresponding description disclose apparatus which has the functions of removing dusty impurities from the machine without causing disturbances and of conveying the transport streams into and out of the cleaning machine with minimal disturbance to the cleaning stream, details and further exemplary embodiments are disclosed in Swiss patent application No. 00 242/89 and in U.S. application Ser. No. 07/470,684 now U.S. Pat. No. 4,964,196, the disclosures of which are incorporated herein by reference in their entireties.

As a variant to the use of suction through a perforated cover 35' and a suction chamber 71 as shown in FIGS. 7–7.2, a suction on the longitudinal side of the machine can be used. This has been shown and described in commonly owned Swiss patent application No. CH 00 967/90-9 and U.S. patent application Ser. No. 07/673,303, the entire disclosures of which are incorporated herein by reference. For simplicity, only a part of the disclosure of the said application is shown here in FIG. 7.3 (a view in the direction I in FIG. 7) and in FIG. 7 with dash-dotted lines.

FIG. 7 shows in dash-dotted lines a suction chamber 81 which is provided between the walls 80 and 90 instead of the suction chamber 71 and which flows into an air escape channel 83 having a throttle flap 89 in the air escape muff 84. In this variant, instead of the perforated cover 35, the wall 80 is perforated essentially along its entire length in the same manner as the cover 35'. Control windows have been indicated at 82 through which the sucked up dust can be controlled or possible cloggings in the wall 80 can be noticed.

FIG. 7.3 further shows in dash-dotted lines that the suction channel 81 may have an air input muff 85 with a throttle flap 86 in order to let in additional air through the suction room 81 for its flushing. Further, FIG. 7.3 also shows in dash-dotted lines that the suction chamber 81 is divided into three essentially vertically directed suction chambers 87.1 or 87.2 or 87.3, the first suction chamber being allocated a throttle flap 88.1, the second suction chamber a throttle flap 88.2 and the third suction chamber a throttle flap 88.3 in order to control the amount of air in each of the suction chambers. A flushing air opening 85 can also serve the three mentioned suction chambers. Basically, the parts of the earlier described FIGS. 7 to 7.2 have the same reference numerals.

Figure 10:
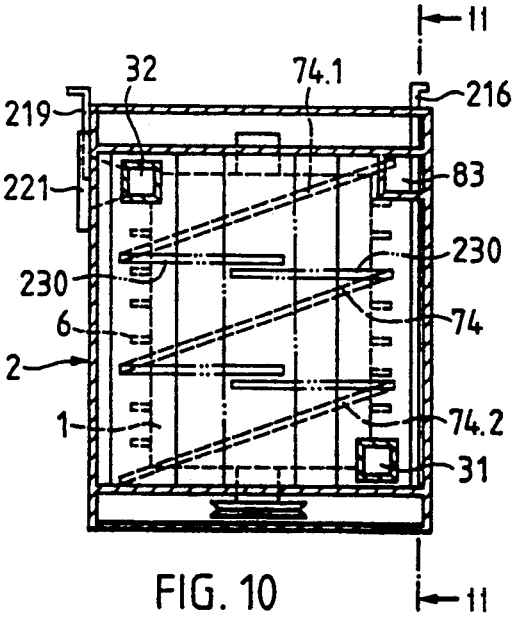
Figure 11:
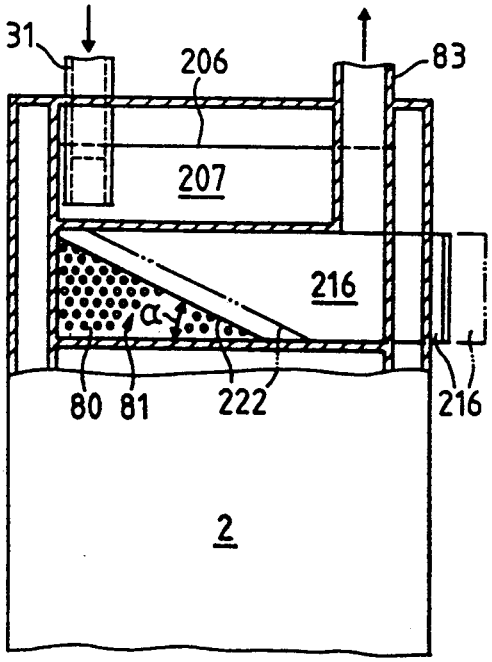

In FIG. 8, 10 and 11 the suction chamber 81 has in comparison to the same suction chamber of FIG. 7.3 additionally a slide 216 with a front edge 222 which is sloped at an angle $\alpha$ toward the horizontal and which covers the perforated wall 80 at least partially, as represented in FIG. 11. This means that the perforated surface 80, to the left of the sloped front edge 222 as seen in FIG. 11, is not covered while this surface to the right of the said front edge is covered by the slide 216. As shown with the dash-dotted line parallel to edge 222, the slide 216 can be slid to the right in FIG. 11 so that the edge 222 can be moved to the position of the dash-dotted line. It is obvious that the slide cannot take just any position within these two lines.

By this measure air which transports the tuft material through the input muff 31 into the machine may be removed through the perforated wall 80.

In principle, the slide 216 could have a vertical edge instead of the sloped edge 222 in FIG. 11, so that the portion of the perforated wall 80 exposed to reduced pressure would not have a triangular form but a squared form. The triangular form is advantageous however. With it, not only can the transporting air of the input muff 31 be removed but also a part of the air and dust rotating with the cylinder I can be separated from the increasingly opened tuft.

However, it is not desired ordinarily that the entire perforated wall 80 be exposed to the vacuum action as shown e.g. in FIG. 7.3. Partial exposure contributes to the purpose of not disturbing the airstream at the outgoing end of the machine by the suction effect. This airstream at the outgoing end (which leaves the machine together with the tuft material through the output muff 32) is formed in the manner illustrated. The outer wall of the machine has an opening 218 at this side of the machine through which fresh air reaches into the space around the cylinder 1 and into the output muff 32. This way the tuft material thrown upwards by the opening cylinder is grabbed by this airstream and transported through the output muff 32.

The opening 218 can be variably closed with a slide 219 which is placed in the guides 220 and 221, so that the amount of air passing through the output muff 32 can be controlled.

The cleaning stream (i.e. the air and the tufts) rotating around the opening cylinder 1 is guided between the separation walls 211, 212 and 213 at the upper half of the opening cylinder 1 and in axial direction towards the output end of the machine so that the tuft is beaten against the grid bars. The stream is given this primarily spiraling circulation path in order to eliminate impurities from the tuft.

In accordance with a feature of the invention, the amount of air rotating around the opening cylinder 1 is such that some air passes through the grid bar of the grid 5 along with impurities and a portion of cleaned fibers. The impurities, due to a higher density and mass and a correspondingly higher kinetic energy, have a primarily straight path into the above-described trough, while the clean fibers pass by the grid bars on the outside together with the air in order to enter into the area of the opening cylinder 1 through an opening 220 where a lower pressure prevails. In order to generate this lower pressure the grid bar area 4 has a so-called baffle plate 223 which replaces a predetermined number of grid bars in this group of grid bars and which can be adjusted with a distance control plate 51 (see FIG. 5.1) just like the replaced portion of the group of grid bars. This baffle plate 223 is adjusted in such a way that the distance of the output edge, seen in the running direction of the opening cylinder is placed closer to the surface of the opening cylinder 1 than the input edge. This creates an increasing baffling between the opening cylinder 1 and the grid bars of the groups of grid bars 4 and 5. Because of this baffling effect the above-mentioned part of the peripheral air passes through the grid bars and a lower pressure in the so-called baffle room is created behind the output edge of the baffle plate 223, this lower pressure having the function of sucking in the air which passed through the grid bars.

This way a so-called wind separation is created. Impurities and clean fibers have different air resistances, due to the various densities between impurities and clean fibers and due to the various forms of impurities and clean fibers. The fibers are ballistically unfavored and have a tendency to follow the air. The heavier impurities, being ballistically favored, have a tendency to be removed from the airstream because of the higher kinetic energy. In other words, the impurities tend to have the ballistic property of a tennis ball and the fibers tend to have the ballistic property of a badminton bird which is easier carried off by an airstream while a tennis ball would leave the airstream due to its inherent kinetic energy.

This way the cleaning effect of the grid bars can be supplemented by a separating effect of the impurities and the fibers with the aid of the airstream.

In order to direct the airstream essentially in the peripheral direction in the area below the grid bars, additional guiding plates 230 can be provided. Advantageously, these guiding plates 230 are not provided in a linear manner but in an overlapping manner as shown in order that no fibers get caught on the upper edge.

As a further measure for influencing the airstream within the above-mentioned wind separation zone, longitudinal elements 240 and 241 can be provided instead of or in addition to the guiding plates 230. These can also be closed off by a cover 250, so that the airstream is additionally deflected into the direction of the trim tank 61 shown in FIG. 6 before it moves off in direction of the opening 220.

Finally, it should be mentioned that the cleaning machine may be operated also without supplying the tufts into the machine via a supplying air stream. If desired, the tufts may be separated from the air before the cleaning machine so that they free-fall into the machine via input 31. In this case input 31 should be designed so that fresh air can reach the machine through this input. Also, air for the airstream can enter through the grid bars without disturbing the suction, in the covers 206–208 or in the lateral perforated wall 80.

All of these measures mentioned above result together in the desired cleaning function as discussed in connection with the block diagram of FIG. 1.

A combination of the measures enables three interrelating function groups to be realized:

- the static adjustment of the cleaning process to the material to be cleaned and to its opening degree which increases in the course of cleaning;
- the decoupling of the dynamics of the cleaning process from all outer dynamic processes in that the cleaning process takes place in a controlled, dynamic balance, being influenced from outer dynamic processes only in a very buffered manner; and
- the dynamic control of the cleaning intensity for fine adjustment in the start-up phase and for compensation of variations in the cleaning stream and in the infed material.

The cleaning machine can, before operation, be equipped with particular regard to the material to be processed. In a start-up phase, the cleaning intensity can be fine adjusted based on measurable product parameters. After start-up, the cleaning process represents a dynamic balance in which the outer dynamics in the supply of the material to be cleaned and in the removal of the cleaned material act only in a very buffered manner. Also, with this system, such effects as variations in the supplied material can be compensated with a dynamic control of the cleaning intensity in such a way that the machine supplies a product of constant and optimum quality. The dynamic control of the cleaning intensity can be fully automated.

Static adjustment of the machine is possible to bring about changes in the length of the cleaning path and in cleaning intensity. Such adjustments can be related to the fiber material to be cleaned and to its degree of opening which increases in the course of cleaning. The length of the cleaning path is determined by the number of transfer chambers, and the cleaning intensity along this cleaning path is determined by the means which limit the cleaning stream, i.e. the diameter of the cylinder and the form and number of the stationary cleaning elements on the cylinder. The following can be changed during operation of the cleaning machine for controlling the cleaning intensity: the distance of the stationary cleaning elements from the cylinder and their slewing position, the rotating speed of the cylinder, the speed of the cleaning stream.

The rotating speed of the cylinder is an essential parameter for the cleaning intensity, the cleaning intensity increasing with increasing rotation. An optimum lies in a balance between cleaning intensity and fiber impairment. That is, the cleaning intensification through increasing rotational speed should end when intolerable fiber impairment starts. This however must be empirically derived from case to case depending on the fiber origin or origin mixture. With increasing rotation of the cylinder there is also an increase of the amount of air rotating with the cylinder 1 and hence of the airstream intensity used for the air separation. This will result in an influence on the separating effect or air separation.

FIG. 2.1 shows schematically a drive motor 300 which drives the opening cylinder 1 and is controlled by a control 301 which receives correction orders for correcting the rotational speed from a command value transmitter 302 or from an evaluation device (not shown). Such a correction can take place in that the product eliminated from the machine as shown in FIG. 6 and 6.1 is measured. Its brightness is examined and the weight of matter eliminated per time unit can be derived so that the rotational speed of the opening cylinder 1 with a given position of the grid bars of the grids 4 and 5 can be changed correspondingly. Such a control is a program control which changes the adjustments based on empirical trial values at correspondingly derived result values.

Finally, it should be mentioned that the cleaning machine in FIGS. 2 to 4 and 6 is shown in a simplified manner, without the room shown in FIGS. 6 and 8 to 11 over the hip roofed cover walls which are perforated walls in FIGS. 7 to 7.2.

What is claimed is:

1. A method for continuous cleaning of fiber material transported in a cleaning stream, the fiber material being cleaned in a cleaning space between a cylinder carrying cleaning elements rotating about a horizontal axis and stationary guiding means forming a spiraled cleaning path for the cleaning stream around the cylinder and cleaning elements, the method comprising:

a) statically adjusting a cleaning intensity of the fiber material at a predetermined length of the cleaning path between an inlet at which the fiber material enters the cleaning stream and an outlet at which fiber material leaves the cleaning stream, in accordance with characteristics of the fiber material to be cleaned and a degree of opening of the fiber material during cleaning, the cleaning intensity being statically adjusted by varying characteristics of the cleaning elements; and b) at least partially decoupling the cleaning stream from a transport means which supplies or removes fiber material or impurities, the cleaning stream being decoupled from the transport means by intersecting points, thereby substantially impeding the transporting means from having an effect on the dynamic behavior of the cleaning stream, whereby the cleaning stream is controllable by means of the cleaning elements which control the cleaning intensity in such a way that the cleaning quality and consistency is optimized independently of the transport means.

2. The method for cleaning fibers according to claim 1, wherein at least a part of the guiding means is air permeable and also has a cleaning and opening function.

3. The method for cleaning fibers according to claim 1, wherein the length of the cleaning path is increased by increasing the number of times the cleaning stream is guided around the cylinder, and wherein the length of the cleaning path is decreased by decreasing the number of times the cleaning stream is guided around the cylinder.

4. The method for cleaning fibers according to claim 1, wherein the cleaning intensity is statically adjusted by varying the width of the cleaning space, by varying the number, length, thickness, shape and density of the stationary cleaning elements fixed to the cylinder, and by varying the permeability of the guiding means.

5. The method for cleaning fibers according to claim 4, wherein the cleaning intensity is adjusted along the cleaning path so as to be uniform, increasing or decreasing by corresponding continuous or step-wise variations in the width of the cleaning space by varying the number, length, thickness, shape and density of the cleaning elements fixed to the cylinder, and by varying the permeability of the guiding means.

6. The method for cleaning fibers according to claim 1, wherein the transporting means is a transporting air stream, the transporting air stream being decoupled from the cleaning stream in an inlet chamber and the transporting air stream being coupled to the cleaning stream at an outlet chamber.

7. The method for cleaning fibers according to claim 1, including forming a buffer layer of impurities between the cleaning space and a discharge gate through which the impurities are discharged.

8. The method for cleaning fibers according to claim 1, including continuously suctioning impurities from the cleaning space, the continuous suctioning of impurities from the cleaning space being buffered by a low-pressure chamber with a throttling organ which is connected between the cleaning space and the suction device.

9. The method for cleaning fibers according to claim 1, wherein the cleaning intensity along the cleaning path is controlled by controlling an amount the stationary cleaning elements protrude into the cleaning stream and by controlling the speeds of the cleaning cylinder and the transport means.

10. The method for cleaning fibers according to claim 9, wherein the cleaning intensity is controlled automatically based upon measured characteristics of the fibers and/or impurities leaving the cleaning space.

11. A method for continuously cleaning tufts in a cleaning stream of a cleaning machine having a jet of air, the tufts being guided into a space formed by a circumference of a cleaning cylinder and cleaning elements positioned at a distance from the cylinder and disposed around the cylinder, the tufts located in the cleaning stream being cleaned in a predetermined portion of the cleaning stream, at least a part of said jet of air being guided out of the cleaning stream, through the cleaning elements and substantially along an outer side of said cleaning elements, and then being guided back into the cleaning stream again so that a separation of dirt particles and fibers takes place.

12. The method according to claim 11, wherein the airstream enters the cleaning stream again with at least a portion of the fibers.

13. The method according to claim 12, wherein the air pressure is higher in the area of the cleaning stream than in the area on the outer side of the cleaning elements.

14. The method according to claim 13, wherein air in the cleaning stream is increasingly compressed in the region of the cleaning elements in order to create a higher air pressure in said region than on the outer side of the cleaning elements.

15. The method according to claim 12, wherein said jet of air is diverted toward the outer side of the cleaning elements substantially in the rotating direction of the cleaning cylinder, said jet of air carrying at least a portion of the fibers to re-introduce them into the cleaning stream and the dirt particles substantially not under-going a deflection into the cleaning stream and therefore being eliminated from the jet of air and collected.

16. The method according to claim 15, wherein air needed for the jet of air is taken from a transporting air stream that guides the tuft into the cleaning machine.

17. The method according to claim 15, wherein air needed for the jet of air is sucked in through an input of the cleaning machine by the cleaning cylinder.

18. The method according to claim 11, wherein the tuft is transported into the machine with a transporting air stream, and thereafter the transporting air stream is substantially removed from the machine.

19. The method according to claim 11, wherein the tufts are fed into the cleaning machine in a free falling manner.

20. The method according to claim 11, wherein the tufts at an output of the cleaning stream are seized by a transporting air stream and transported out of the machine.

21. The method according to claim 20, wherein the transporting air stream is sucked into the cleaning machine from outside the machine.

22. The method according to claim 11, wherein the cleaning stream is transported around the cleaning cylinder in a spiraling path that extends from one axial end of the cleaning cylinder to an opposite axial end of the cleaning cylinder.

23. The method according to claim 11, wherein the intensity of the jet of air is adjustable.

24. The method according to claim 23, wherein the intensity of the jet of air is adjustable by adjusting a rotational speed of the cleaning cylinder.

25. The method according to claim 23, wherein the intensity of the jet of air is adjustable by adjusting the amount of air in the cleaning stream.

26. A device for cleaning fiber material comprising: a cleaning cylinder which rotates about a horizontal axis within a casing, guiding means for dividing a space above the cylinder into transfer chambers, an inlet chambers and an outlet chamber, one at least partially air and dust permeable cover in a region of said chambers, at least one low-pressure chamber positioned above said cover, the cylinder being provided with cleaning elements having a length, thickness, shape and/or density that varies along the length of the cylinder, the diameter of the cylinder being variable along the cylinder length, stationary cleaning elements, and means for adjusting a distance of said stationary cleaning elements in relation to the cylinder and for adjusting a position of said stationary cleaning elements.

27. A device for cleaning tuft material comprising:

a driveable rotating cleaning cylinder positioned in a casing and having cleaning elements provided on a periphery thereof;

an inlet for the tuft material to be cleaned and an outlet;

adjustable grid bars positioned in a lower area of the periphery of the cylinder to define a cleaning space between the cleaning cylinder and the grid bars, each of the grid bars having a longitudinal axis; and the grid bars being adjustable in a radial direction relative to the cleaning cylinder and being adjustable about their respective longitudinal axes so that the radial distance of each grid bar relative to the cleaning cylinder and the axial position of each grid bar is variable from grid bar to grid bar, and an opening positioned after a last one of the grid bars in the direction of rotation of the cylinder so that an air stream can enter into the cleaning stream.

28. The device according to claim 27, wherein a buffer plate is positioned adjacent the grid bars and before said opening with respect to the rotating direction of the cleaning cylinder.

29. The device according to claim 27, including means for sucking off transporting air from the tufts entering into the cleaning stream.

30. The device according to claim 27, including an opening for inputting suction air for carrying off cleaned tufts, said opening being positioned adjacent the output of the cleaning cylinder.

31. The device according to claim 30, including a slide for reducing a size of the opening.

32. The device according to claim 30, wherein the means for sucking transporting air includes a throttle for controlling the amount of air that is sucked.

33. The device according to claim 27, including guiding elements positioned in a lower area of the cleaning cylinder below the grid bars so that air which moves into said lower area is substantially guided in the peripheral direction of the cylinder.

34. The device according to claim 27, including means for adjusting the rotation of the cleaning cylinder.

35. The method according to claim 27, including means for determining a brightness of waste.

* * * * *